US009004603B1

(12) United States Patent
Wang

(10) Patent No.: US 9,004,603 B1
(45) Date of Patent: Apr. 14, 2015

(54) ARMREST ASSEMBLY FOR A CHAIR

(71) Applicant: Chih-Wei Wang, Tainan (TW)

(72) Inventor: Chih-Wei Wang, Tainan (TW)

( * ) Notice: Subject to any disclaimer, the term of this patent is extended or adjusted under 35 U.S.C. 154(b) by 0 days.

(21) Appl. No.: 14/229,972

(22) Filed: Mar. 30, 2014

(51) Int. Cl.
*A47C 7/54* (2006.01)

(52) U.S. Cl.
CPC ..... *A47C 7/54* (2013.01)

(58) Field of Classification Search
CPC ..... A47C 1/03; A47C 7/54; A47C 1/031; A47B 2021/0392; A61G 2005/125
USPC ..... 297/411.35, 411.36, 411.37
See application file for complete search history.

(56) References Cited

U.S. PATENT DOCUMENTS

| | | | | |
|---|---|---|---|---|
| 7,159,947 | B1 * | 1/2007 | Lee | 297/411.37 |
| 7,188,907 | B1 * | 3/2007 | Lai | 297/411.35 |
| 7,387,341 | B1 * | 6/2008 | Tsai | 297/411.35 |
| 2004/0183355 | A1 * | 9/2004 | Lee et al. | 297/411.36 |
| 2006/0226691 | A1 * | 10/2006 | Bedford et al. | 297/411.36 |
| 2006/0250018 | A1 * | 11/2006 | Tsai | 297/411.36 |
| 2007/0024100 | A1 * | 2/2007 | Chan | 297/411.36 |
| 2008/0191537 | A1 * | 8/2008 | Oda | 297/411.36 |
| 2012/0025584 | A1 * | 2/2012 | Chen et al. | 297/411.37 |

FOREIGN PATENT DOCUMENTS

EP 2474249 A1 * 7/2012

* cited by examiner

*Primary Examiner* — Milton Nelson, Jr.

(57) ABSTRACT

An armrest assembly includes an adjusting seat received in a base slideable in a length direction. The adjusting seat is slideable in a width direction relative to a seat fixed to the base. A first control button initially engaged with the adjusting seat can be operated to disengage from the adjusting seat and to disengage a transverse positioning block from the seat, allowing adjustment in the length and width directions. A lower rod is fixed to a chair body and is received in an upper rod movable in a height direction. A second control button is mounted in a window in the upper rod and includes engagement teeth engaged with a gear on a screw rod in threading connection with a screw rod coupling seat on the lower rod. The second control button can be operated to disengage the engagement teeth from the gear, allowing adjustment in the height direction.

8 Claims, 12 Drawing Sheets

C – C

D - D

ARMREST ASSEMBLY FOR A CHAIR

BACKGROUND OF THE INVENTION

The present invention relates to an armrest assembly for a chair and, more particularly, to an armrest assembly for a chair allowing adjustment of a position of an armrest unit in the length, width, and height directions.

A conventional chair armrest assembly generally includes a support rod fixed to the chair body and an armrest mounted on top of the support rod for supporting an arm of a user. Adjusting devices for adjusting the position or height of the armrest have been proposed, and U.S. Pat. No. 7,387,341 discloses an example of the adjusting devices. Specifically, an armrest assembly of a chair disclosed in U.S. Pat. No. 7,387,341 includes a fixing board, a first movable board, two limit plates, a second movable board, a positioning body, a restoring spring, a lining, a foam body, a push button, a bottom cap, and two shading plates. The fixing board includes a plurality of positioning holes. The push button can be pressed to disengage the positioning body from the positioning holes to allow adjustment of the position of the foam body in the length direction and the width direction. After adjustment, the push button is released to engage the positioning body into one of the positioning holes. However, the armrest assembly is complicated in structure. Furthermore, the adjustment is restricted by the locations of the positioning holes.

In another approach, the support rod includes a plurality of engagement holes spaced from each other in the vertical direction. When the armrest moves upward or downward, an engagement member moving together with the armrest engages with one of the engagement holes to position the armrest. However, the spacing between the engagement holes does not allow exact position adjustment of the armrest in the vertical direction.

U.S. Pat. No. 7,661,763 discloses an armrest including a support arm mounted on a sleeve movably mounted on a support post. A locking member is fixed to an upper end of the support rod and includes a semi-circular locking hole. A control knob and a movable shaft are mounted to the sleeve. The movable shaft includes an arcuate portion with vertically spaced locking teeth selectively engaged with a rectilinear locking side of the locking hole. The control knob can be pressed to rotate the movable shaft through an angle to a position in which the arcuate portion is aligned with an arcuate side of the locking hole, allowing the movable shaft to move in the vertical direction for adjusting the height of the support arm. However, the spacing between two adjacent teeth of the movable shaft does not allow exact height adjustment. Furthermore, adjustment is not easy if the arcuate portion of the movable shaft is not exactly aligned with the arcuate side of the locking hole.

BRIEF SUMMARY OF THE INVENTION

An objective of the present invention is to provide an armrest assembly for a chair allowing adjustment of a position of an armrest unit in the length, width, and height directions while providing more stable operation, assembling convenience, and comfort.

An armrest assembly according to the present invention includes an armrest unit and a support rod unit. The armrest unit includes a base including a receiving portion having a first sidewall and a first bottom wall. The first sidewall includes a notch. The first bottom wall includes an opening. The armrest unit further includes an adjusting seat mounted in the receiving portion of the base. The adjusting seat includes a second bottom wall and a second sidewall. The adjusting seat has a length in a length direction smaller than a length of the receiving portion of the base in the length direction. The base is movable relative to the adjusting seat in the length direction. The second bottom wall of the adjusting seat further includes a transverse slot having a wall with a plurality of transverse positioning teeth spaced from each other in a width direction perpendicular to the length direction. A tooth groove is defined between two adjacent transverse positioning teeth. A first elastic element includes an end attached to the adjusting seat. The second sidewall includes an inner face having a plurality of vertical positioning teeth spaced from each other in the length direction.

The armrest unit further includes a seat including a third bottom wall having a length in the length direction larger than a length of the transverse slot in the length direction. The seat further includes a positioning portion extending through the opening of the base and received in the transverse slot of the adjusting seat. A mounting board is mounted in the transverse slot and is fixed to the positioning portion. The mounting board has a length in the length direction larger than the length of the transverse slot. The adjusting seat is coupled to the seat and is slideable relative to the seat in the width direction. The positioning portion of the seat includes a plurality of positioning grooves corresponding to the plurality of transverse positioning teeth.

The armrest unit further includes a transverse positioning block mounted on the adjusting seat. The transverse positioning block is movable in the length direction. The transverse positioning block includes a plurality of teeth. The plurality of teeth of the transverse positioning block is engageable with the plurality of transverse positioning teeth and the plurality of positioning grooves of the base. The transverse positioning block further includes an engagement portion having a guiding peg.

The armrest unit further includes an actuating board mounted above the transverse positioning block and movable relative to the adjusting seat in the width direction. The first elastic element has another end attached to a side of the actuating board. The actuating board further includes a slant guiding slot extending in a direction at an acute angle to the length and width directions. The guiding peg of the transverse positioning block is slideably received in the slant guiding slot of the actuating board. The actuating board further includes an abutment portion.

The armrest unit further includes a first control button including a side having a pressing portion. The pressing portion extends out of the notch of the base. The first control button further includes a plurality of teeth engageable with the plurality of vertical positioning teeth of the adjusting seat. The first control button further includes an abutment side abutting the abutment portion of the actuating board. The armrest unit further includes an upper cover fixed to and covering the base.

The first elastic element biases the plurality of teeth of the transverse positioning block to extend through the tooth grooves of the plurality of transverse positioning teeth and to engage with the plurality of positioning grooves of the base. The plurality of teeth of the first control button engages with the plurality of vertical positioning teeth of the adjusting seat, positioning the armrest unit in the length and width directions.

If the first control button is pressed by the pressing portion, the actuating board is moved, the plurality of teeth of the transverse positioning block disengages from the tooth grooves of the plurality of transverse positioning teeth and the plurality of positioning grooves of the base, the plurality of teeth of the first control button disengages from the plurality of vertical positioning teeth of the adjusting seat, allowing adjustment of a position of the armrest unit in the length direction and the width direction.

The support rod unit includes a lower rod adapted to be fixed to a body of a chair. The lower rod includes a receptacle extending in an axial direction of the lower rod. A screw rod coupling seat is received in the receptacle and includes a screw hole. The support rod unit further includes an upper rod including a peripheral wall having an inner peripheral face defining a longitudinal hole. The lower rod is received in the longitudinal hole of the upper rod. The peripheral wall of the upper rod further includes a window in communication with the longitudinal hole. A connection board is fixed to an upper end of the upper rod and is fixed to the seat. The connection board has an axial hole in communication with the longitudinal hole. The support rod unit further includes a screw rod recessed in the longitudinal hole of the upper rod. The screw rod is in threading connection with the screw rod coupling seat. An axle is formed on an upper end of the screw rod. The axle is rotatably coupled to the axial hole of the connection board. The screw rod further includes a gear aligned with the window of the upper rod. The support rod unit further includes a second control button mounted in the window of the upper rod. The second control button includes engagement teeth. The position of the armrest unit in a height direction perpendicular to the length and width directions is fixed when the engagement teeth of the second control button engage with the gear on the screw rod. The position of the armrest unit in the height direction is adjustable if the second control button is operated to disengage the engagement teeth from the gear on the screw rod.

Preferably, the second bottom wall of the adjusting seat includes two mounting holes. The actuating board includes two transverse holes aligned with the two mounting holes of the adjusting seat. Two fasteners extend through the two transverse holes of the actuating board into the two mounting holes of the adjusting seat. The actuating board is slideable relative to the adjusting seat in the width direction.

Preferably, the base further includes a stop wall. The side of the first control button includes an abutment edge. When the first control button is pressed, the abutment edge of the first control button abuts against the stop wall of the base to stop further movement of the first control button.

Preferably, the first sidewall of the base includes an inner edge having a plurality of vertical teeth spaced from each other in the length direction. The adjusting seat further includes a resilient arm having a protrusion. The protrusion of the resilient arm is selectively and releasably engaged with one of the plurality of vertical teeth of the first sidewall of the base.

Preferably, the lower rod further includes at least one longitudinal groove defined in an inner periphery of the receptacle of the lower rod. At least one fixing hole is defined in a top end face of the lower rod. The screw rod coupling seat includes an outer periphery with at least one rib. The screw rod coupling seat further includes at least one fixing hole. The at least one rib is engaged in the at least one longitudinal groove. At least one fastener extends through the at least one fixing hole of the screw rod coupling seat and the at least one fixing hole of the lower rod, preventing the screw rod coupling seat form rotating in the receptacle.

Preferably, the third bottom wall of the base further includes at least one mounting hole. The coupling board on the upper rod includes at least one mounting hole. At least one lug is formed on an inner periphery of the longitudinal groove of the upper rod and has a mounting hole. At least one fastener extends through the at least one mounting hole of the base, the at least one mounting hole of the coupling board, and the mounting hole of the at least one lug of the upper rod.

Preferably, the screw rod further includes a plate fixed to a lower end of the screw rod. The plate has a diameter larger than a diameter of the screw hole.

The upper rod further includes two tracks formed on the inner peripheral face of the longitudinal hole of the upper rod. The second control button includes a positioning body received in the longitudinal hole of the upper rod. The positioning body includes two edges slideably received in the two tracks. The positioning body is moveable relative to the upper rod in the height direction. The positioning body includes the engagement teeth. The second control button further includes a manual portion aligned with the window of the upper rod. The manual portion extends through the window and includes a tab received in the longitudinal hole of the upper rod and abutting the inner peripheral face of the longitudinal hole. The manual portion further includes an operative portion located outside of the upper rod. The manual portion is coupled to the positioning body. The manual portion and the positioning body are jointly moveable in the height direction. The second control button further includes a second elastic element having a first end attached to the positioning body and a second end attached to the coupling board.

The present invention will become clearer in light of the following detailed description of illustrative embodiments of this invention described in connection with the drawings.

DESCRIPTION OF THE DRAWINGS

FIG. 1A is an enlarged view of a circled portion of FIG. 1.

FIG. 9A is an enlarged view of a circled portion of FIG. 9.

FIG. 11A is an enlarged view of a circled portion of FIG. 11.

FIG. 12A is an enlarged view of a circled portion of FIG. 12.

DETAILED DESCRIPTION OF THE INVENTION

Figure 1:
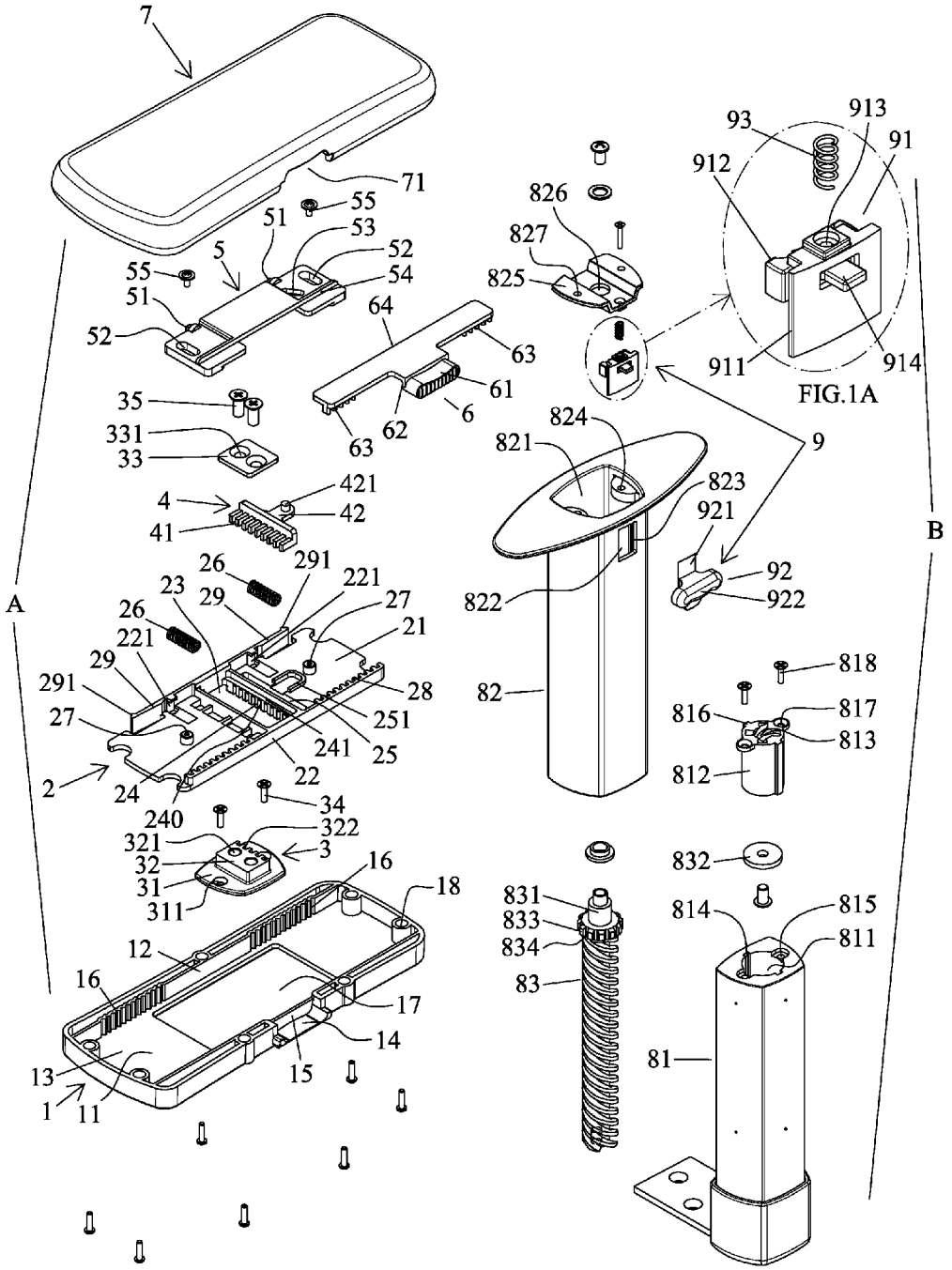
FIG. 1 is an exploded, perspective view of an armrest assembly according to the present invention.
Figure 2:
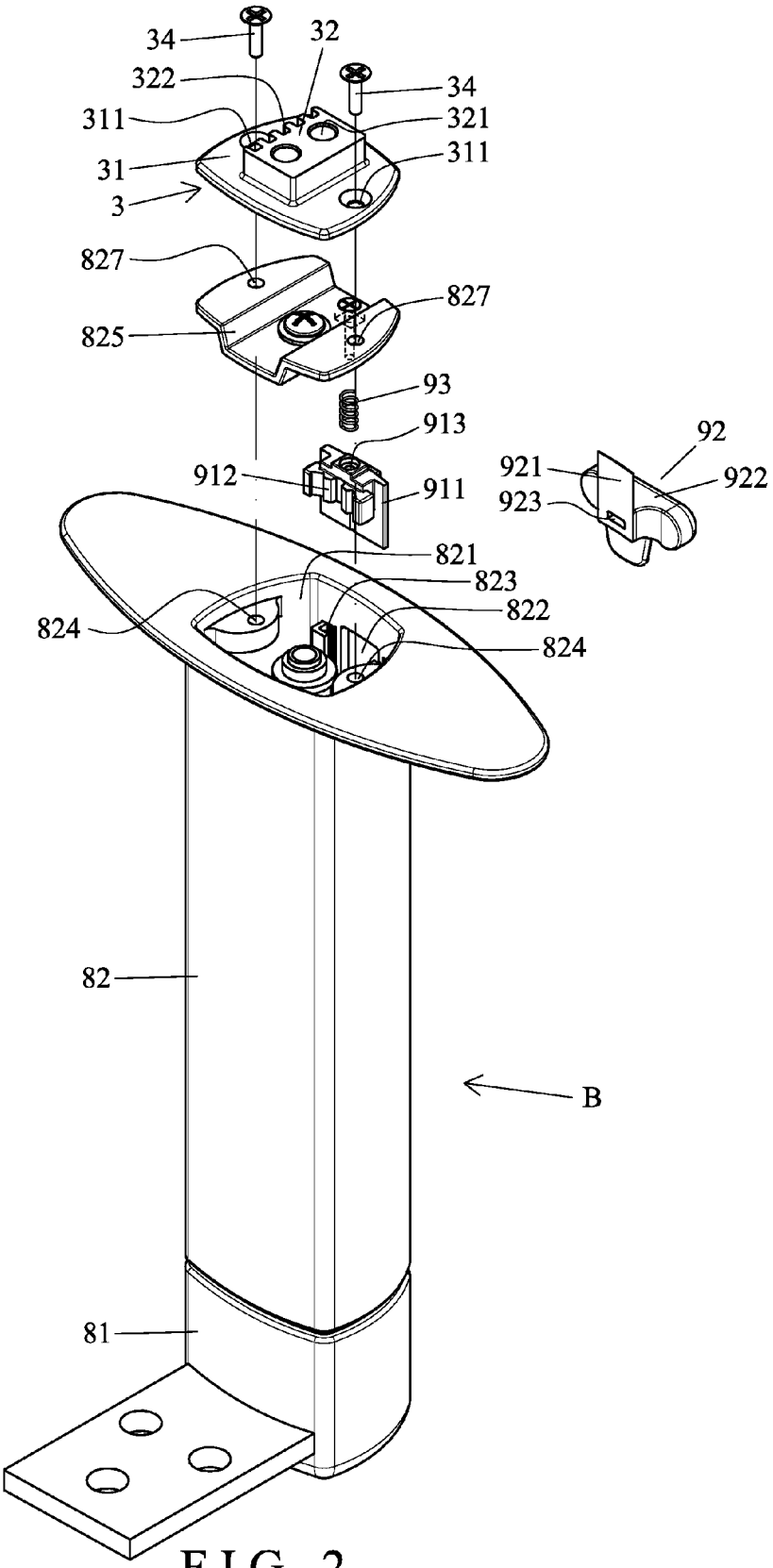
FIG. 2 is a perspective view of the armrest assembly of FIG. 1, with some components exploded.
Figure 3:
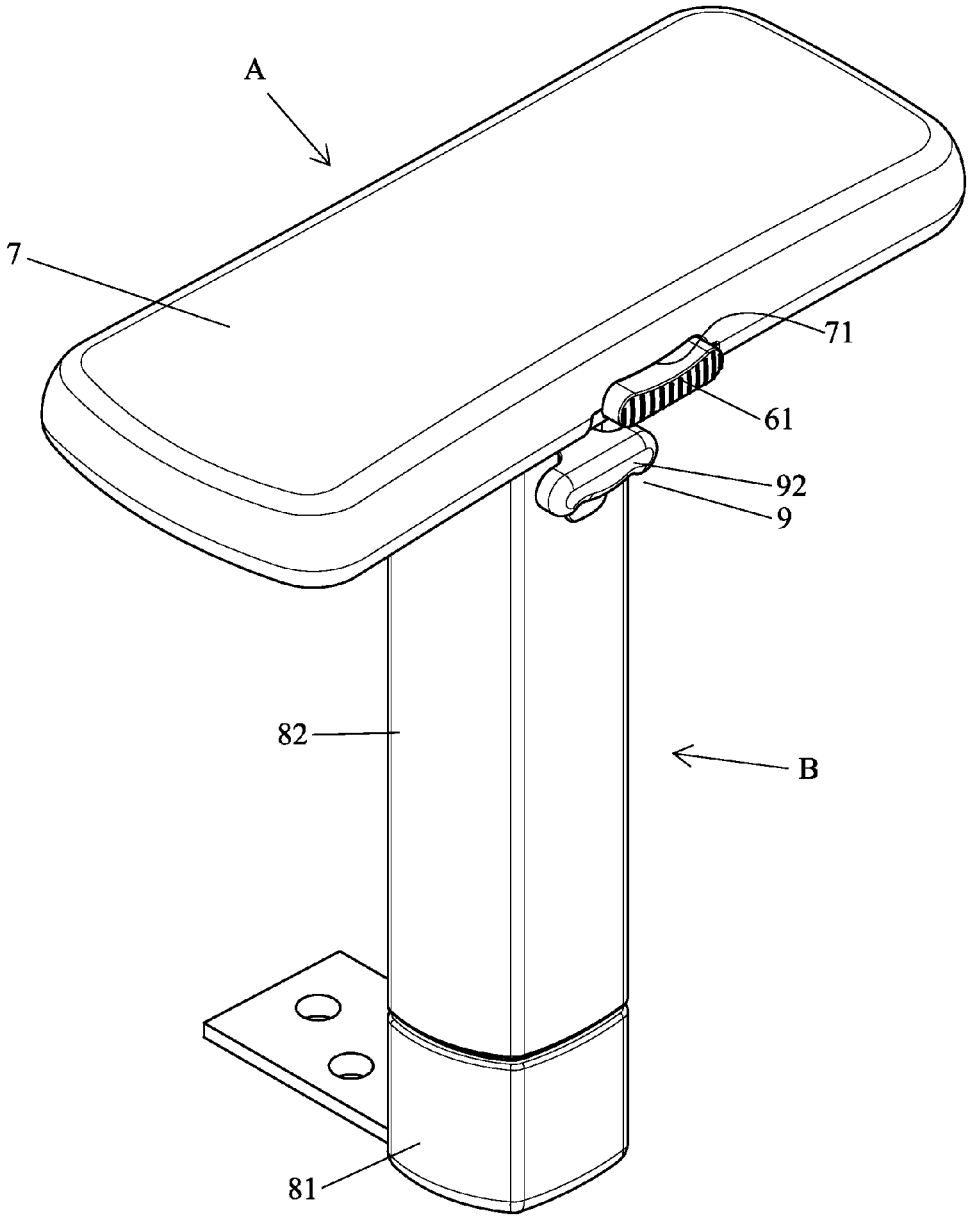
FIG. 3 is a perspective view of the armrest assembly of FIG. 1.
Figure 4:
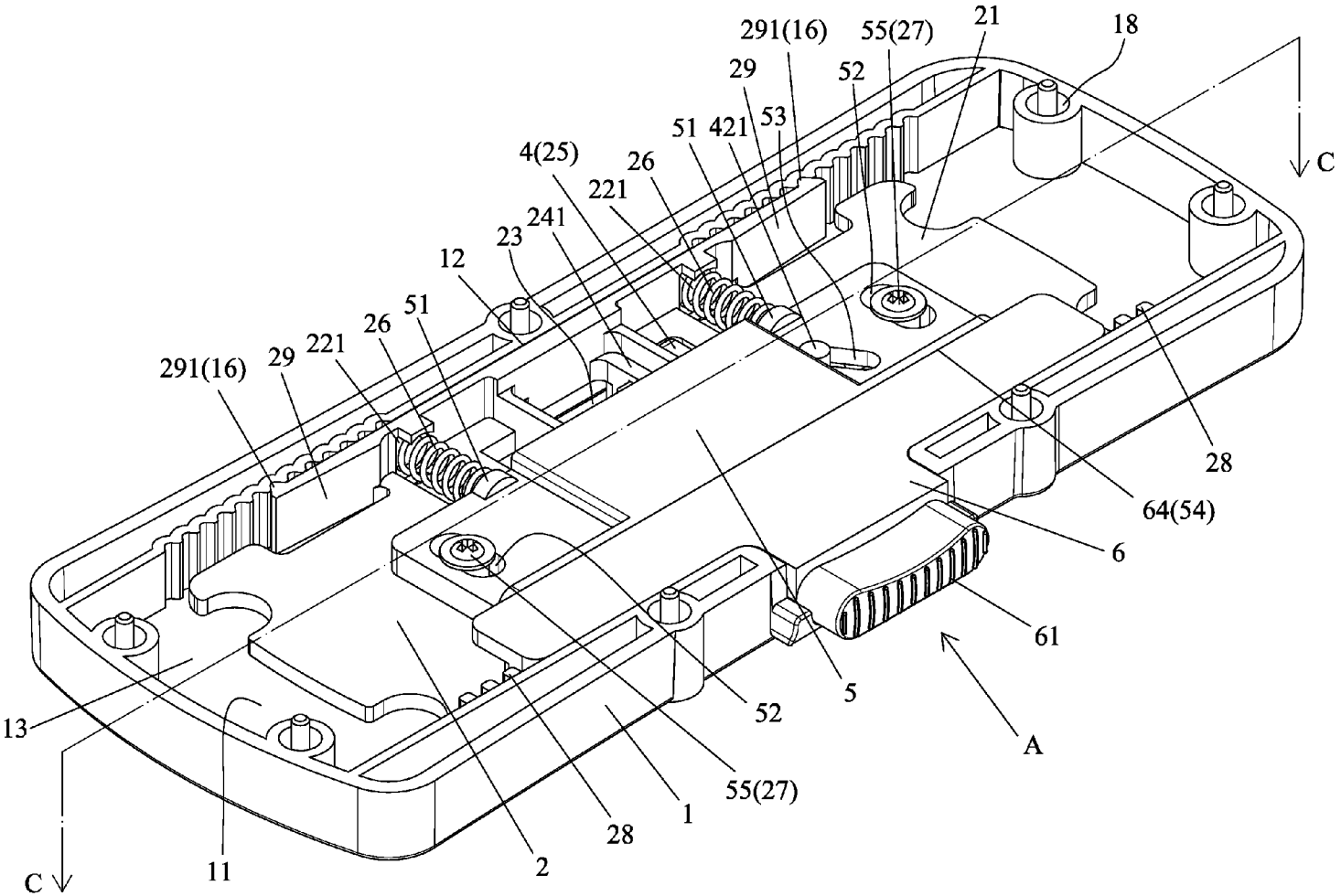
FIG. 4 is a perspective view of an armrest unit of the armrest assembly of FIG. 1, with an upper cover removed.
Figure 5:
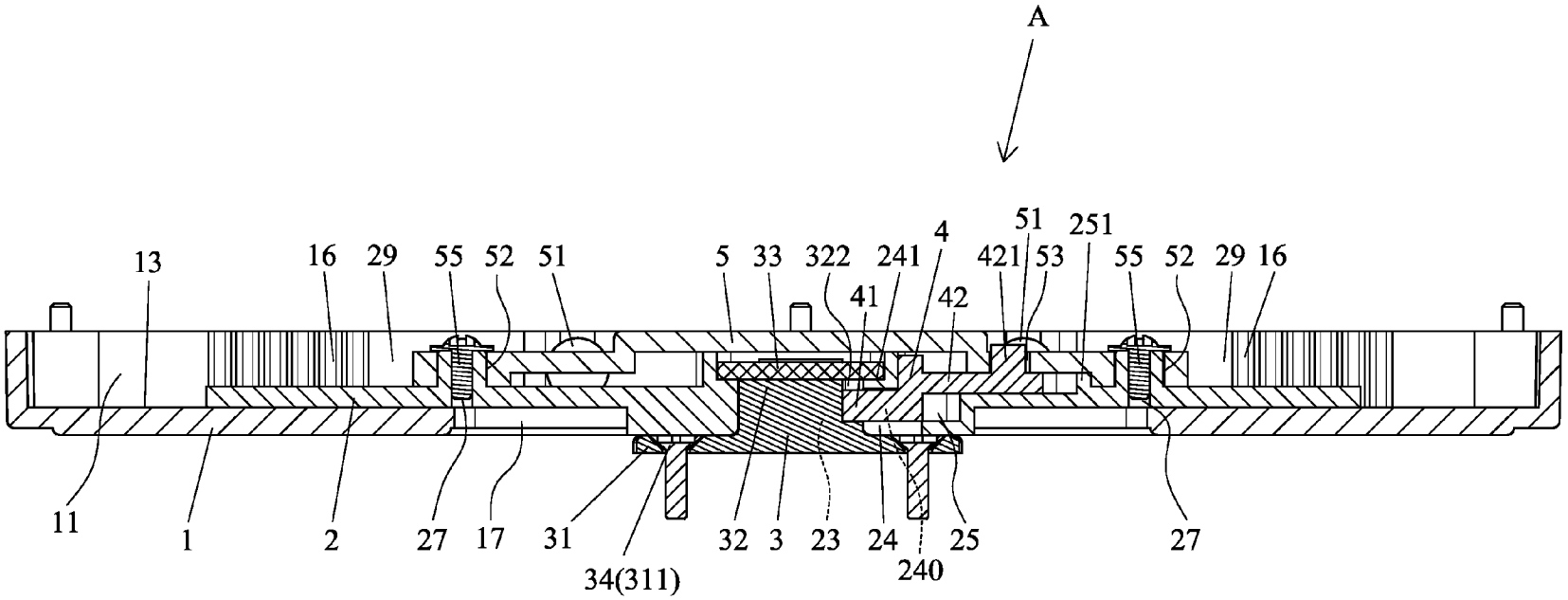
FIG. 5 is a cross sectional view taken along section line C-C of FIG. 4.

With reference to FIGS. 1-6, an armrest assembly for a chair according to the present invention includes an armrest unit A and a support rod unit B. The armrest unit A includes a base 1, an adjusting seat 2, a seat 3, a transverse positioning block 4, an actuating board 5, a first control button 6, and an upper cover 7. The base 1 includes a receiving portion 11 having a first sidewall 12 and a first bottom wall 13 extending perpendicularly to the first sidewall 12. In the form shown, the first sidewall 12 includes a first portion and a second portion opposite to the first portion. The first portion has a notch 14. The second portion includes an inner edge having a plurality of vertical teeth 16 spaced from each other in a length direction. The base 1 further includes a stop wall 15 between the notch 14 and the vertical teeth 16 in a width direction perpendicular to the length direction. The first bottom wall 13 includes an opening 17 allowing movement of the base 1 in the length direction and the width direction. The base 1 further includes a plurality of fixing holes 18.

The adjusting seat 2 is mounted in the receiving portion 11 of the base 1 and includes a second bottom wall 21 and a second sidewall 22 extending perpendicularly to the second bottom wall 21. The adjusting seat 2 has a length in the length direction smaller than a length of the receiving portion 11 of the base 1 in the length direction. The base 1 is movable relative to the adjusting seat 2 in the length direction. The second bottom wall 21 of the adjusting seat 2 further includes a transverse slot 23 having two walls spaced from each other in the length direction. One of the walls of the transverse slot 23 has a plurality of transverse positioning teeth 24 spaced from each other in the width direction. A tooth groove 240 is defined between two adjacent transverse positioning teeth 24. Each wall of the transverse slot 23 has a ledge 241. A recessed portion 25 is formed on the second bottom wall 21 and is located adjacent to the transverse positioning teeth 24. The recessed portion 25 includes a ridge 251.

Two elastic elements 26 are provided. Each elastic element 26 includes an end attached to one of two coupling portions 221 on the second sidewall 22 of the adjusting seat 2. The second bottom wall 21 of the adjusting seat 2 further includes two mounting holes 27 on opposite sides of the transverse slot 23. The second sidewall 22 includes an inner face having a plurality of vertical positioning teeth 28 spaced from each other in the length direction. The adjusting seat 2 further includes two resilient arms 29 each having a protrusion 291. The protrusion 291 of each resilient arm 29 is selectively and releasably engaged with one of the vertical teeth 16 of the first sidewall 12 of the base 1. It can be appreciated that the adjusting seat 2 can include only one resilient arm 29.

The seat 3 includes a third bottom wall 31 having a length in the length direction larger than a length of the transverse slot 23 (the spacing between the two walls of the transverse slot 23) in the length direction. The seat 3 further includes at least one mounting hole 311 through which at least one fastener 34 extends to fix the seat 3 to the support rod unit B. The seat 3 further includes a positioning portion 32 extending through the opening 17 of the base 1 and received in the transverse slot 23 of the adjusting seat 2. The positioning portion 32 includes fixing holes 321. The positioning portion 32 of the seat 3 further includes a plurality of positioning grooves 322 corresponding to the plurality of transverse positioning teeth 24. A mounting board 33 is mounted in the transverse slot 23 and rests on the ledges 241. The mounting board 33 has a length in the length direction larger than the length of the transverse slot 23. The mounting board 33 includes fixing holes 331. Fasteners 35 extend through the fixing holes 331 of the mounting board 33 into the fixing holes 321 of the positioning portion 33. Thus, the adjusting seat 2 is coupled to the seat 3 and is slideable relative to the seat 3 in the width direction.

The transverse positioning block 4 is mounted in the recessed portion 25 of the adjusting seat 2 and is movable relative to the adjusting seat 2 in the length direction. The transverse positioning block 4 includes a plurality of teeth 41. The teeth 41 can extend through the tooth grooves 241 of the transverse positioning teeth 24 and can engage with the positioning grooves 322 of the base 3. The transverse positioning block 4 further includes an engagement portion 42 having a guiding peg 421.

The actuating board 5 is mounted above the transverse positioning block 4 and abuts the ridge 251 of the adjusting seat 2. The actuating board 5 further includes two mounting portions 51 on a side thereof. The other end of each elastic element 26 is attached to one of the mounting portions 51. The actuating board 5 further includes two transverse holes 52 aligned with the mounting holes 27 of the adjusting seat 2. The actuating board 5 further includes a slant guiding slot 53 extending in a direction at an acute angle to the length and width directions. Two fasteners 55 extend through the transverse holes 52 of the actuating board 5 into the mounting holes 27 of the adjusting seat 2, with the guiding peg 421 of the transverse positioning block 4 slideably received in the slant guiding slot 53 of the actuating board 5. The actuating board 5 is slideable relative to the adjusting seat 2 in the width direction. The transverse positioning block 4 is moved in the length direction when the actuating board 5 moves in the width direction. The actuating board 5 further includes an abutment portion 54.

With reference to FIGS. 1-3, 9, and 10, the first control button 6 is mounted above the adjusting seat 2. The first control button 6 includes a side having a pressing portion 61. The pressing portion 61 extends out of the notch 14 of the base 1 for manual operation. The side of the first control button 6 further includes an abutment edge 62. After the first control button 6 has moved through a distance, the abutment edge 62 of the first control button 6 abuts against the stop wall 15 of the base 1 to stop further movement of the first control button 6. The first control button 6 further includes a plurality of teeth 63 engageable with the vertical positioning teeth 28 of the adjusting seat 2. The first control button 6 further includes an abutment side 64 abutting the abutment portion 54 of the actuating board 5. The upper cover 7 is fixed to and covers the base 1. The cover 7 includes a notch 71 through which the pressing portion 61 of the first control button 6 extends.

The support rod unit B includes a lower rod 81, an upper rod 82, a screw rod 83, and a second control button 9. The lower rod 81 is adapted to be fixed to a body of a chair (not shown). The lower rod 811 includes a receptacle 811 extending in an axial direction of the lower rod 81. A screw rod coupling seat 812 is received in the receptacle 811 and includes a screw hole 813. The lower rod 81 further includes at least one longitudinal groove 814 defined in an inner periphery of the receptacle 811 of the lower rod 81. At least one fixing hole 815 is defined in a top end face of the lower rod 81. The screw rod coupling seat 812 includes an outer periphery having at least one rib 816. The screw rod coupling seat 812 further includes at least one fixing hole 817. The at least one rib 816 is engaged in the at least one longitudinal groove 814. At least one fastener 818 extends through the at least one fixing hole 817 of the screw rod coupling seat 812 and the at least one fixing hole 815 of the lower rod 81, preventing the screw rod coupling seat 812 form rotating in the receptacle 811.

The upper rod 82 includes a peripheral wall having an inner peripheral face defining a longitudinal hole 821. The lower rod 81 is received in the longitudinal hole 821 of the upper rod 82. The peripheral wall of the upper rod 82 further includes a window 822 in communication with the longitudinal hole 821. The window 822 receives the second control button 9. Two tracks 823 are formed on the inner peripheral face of the longitudinal hole 821 of the upper rod 82. A connection board 825 is fixed to an upper end of the upper rod 82 and is fixed to the seat 3. The coupling board 825 includes at least one mounting hole 827. At least one lug is formed on an inner periphery of the longitudinal groove 821 of the upper rod 82 and has a mounting hole 824. At least one fastener 34 extends through the at least one mounting hole 311 of the base 3, the at least one mounting hole 827 of the coupling board 825, and the mounting hole 824 of the at least one lug of the upper rod 82. The connection board 825 further includes an axial hole 826 in communication with the longitudinal hole 821.

The screw rod 83 is received in the longitudinal hole 821 of the upper rod 82 and is in threading connection with the screw rod coupling seat 812. An axle 831 is formed on an upper end of the screw rod 83 and is rotatably coupled to the axial hole 826 of the connection board 825. The screw rod 83 further includes a plate 832 fixed to a lower end of the screw rod 83. The plate 832 has a diameter larger than a diameter of the screw hole 813. The screw rod 83 is rotatable relative to the lower rod 81 to cause movement of the upper rod 82 in a height direction perpendicular to the length and width directions. The plate 832 avoids the screw rod 83 from disengaging from the screw rod coupling seat 812. The screw rod 83 further includes a gear 833 aligned with the window 822 of the upper rod 82. The gear 833 includes a plurality of tooth grooves 834 spaced from each other in a circumferential direction about the rotating axis of the screw rod 83.

The second control button 9 is mounted in the window 822 of the upper rod 82. The second control button 9 includes a positioning body 91, a manual portion 92, and a second elastic element 93. The positioning body 91 is received in the longitudinal hole 821 of the upper rod 82. The positioning body 91 includes two edges 911 slideably received in the tracks 823 such that the positioning body 91 is moveable relative to the upper rod 82 in the height direction. The positioning body 91 including engagement teeth 912 releasably engaged with the gear 833. The positioning body 91 further includes a spring mounting seat 913 on an upper end thereof. A coupling member 914 is provided on an outer side of the positioning body 91.

Figure 9:
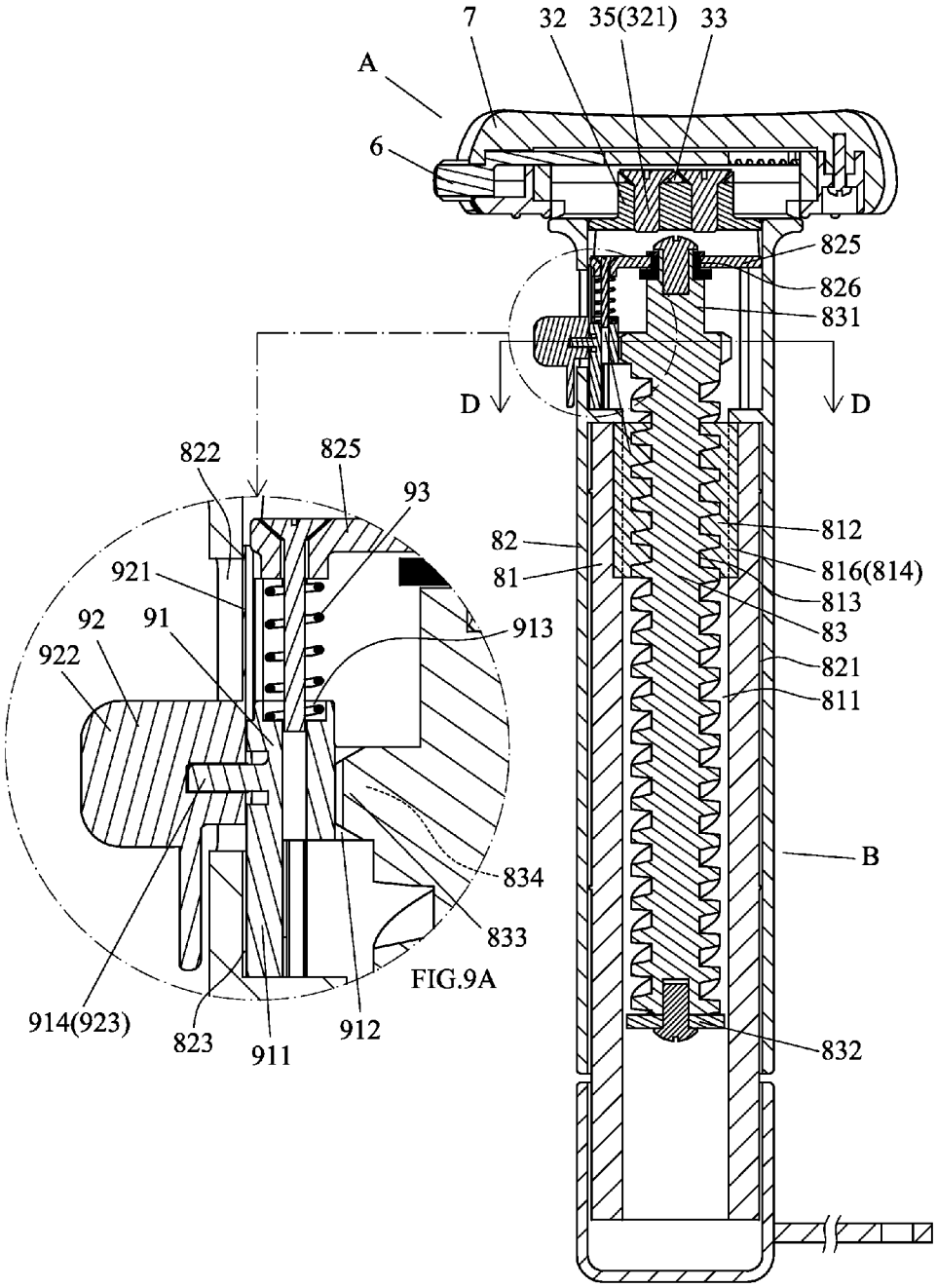
FIG. 9 is a cross sectional view of the armrest assembly, with a second control knob not pressed.
Figure 10:
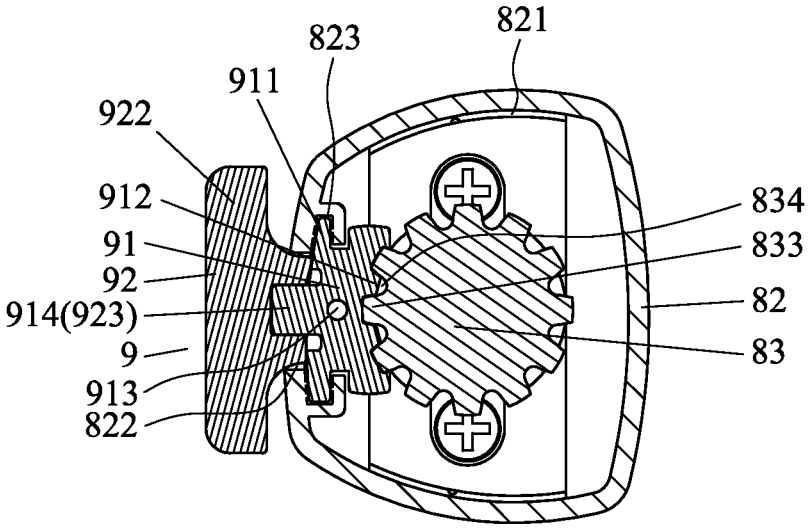
FIG. 10 is a cross sectional view taken along section line D-D of FIG. 9.

The manual portion 92 is aligned with the window 822 of the upper rod 82. The manual portion 92 extends through the window 822 and includes a tab 921 received in the longitudinal hole 821 of the upper rod 82 and abutting the inner peripheral face of the longitudinal hole 821. The manual portion 92 further includes an operative portion 922 located outside of the upper rod 82. The manual portion 92 further includes an inner side having a coupling hole 923 coupled to the coupling member 914. Thus, the manual portion 92 and the positioning body 91 are jointly moveable in the height direction. The elastic element 93 is in the form of a compression spring and includes a first end attached to the spring mounting seat 913 of the positioning body 91 and a second end attached to the coupling board 825. With reference to FIGS. 9 and 10, when the second control button 9 is not operated, the elastic element 93 biases the engagement teeth 912 of the positioning body 91 to engage with the tooth grooves 834 of the gear 833.

In assembly, the screw rod 83 of the support rod unit B is in threadedly engaged with the screw rod coupling seat 812 of the lower rod 81 and is coupled to the upper rod 82. The second control button 9 is mounted to the upper rod 82. The seat 3 of the armrest unit A is fixed to the upper rod 82. The adjusting seat 2 is mounted to the base 1 and is coupled to the seat 3. The actuating board 5, the transverse positioning block 4, and the first control button 6 are then mounted to the adjusting seat 2. Then, the upper cover 7 is mounted to the base 1 to finish assemblage of the armrest assembly. The assemblage is convenient.

Figure 6:
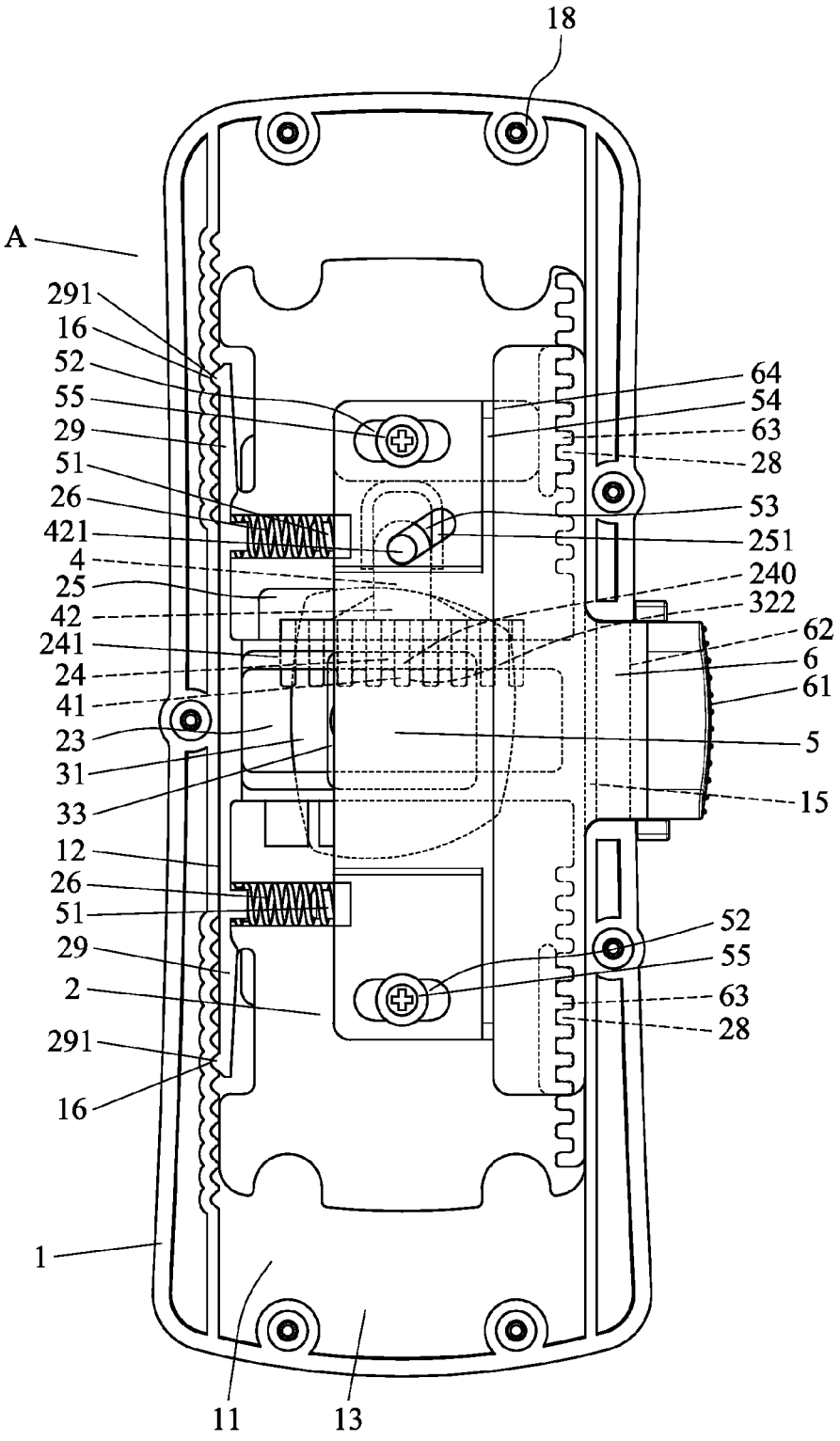
FIG. 6 is a top view of the armrest unit, with the upper cover removed, and with a first control knob not pressed.
Figure 7:
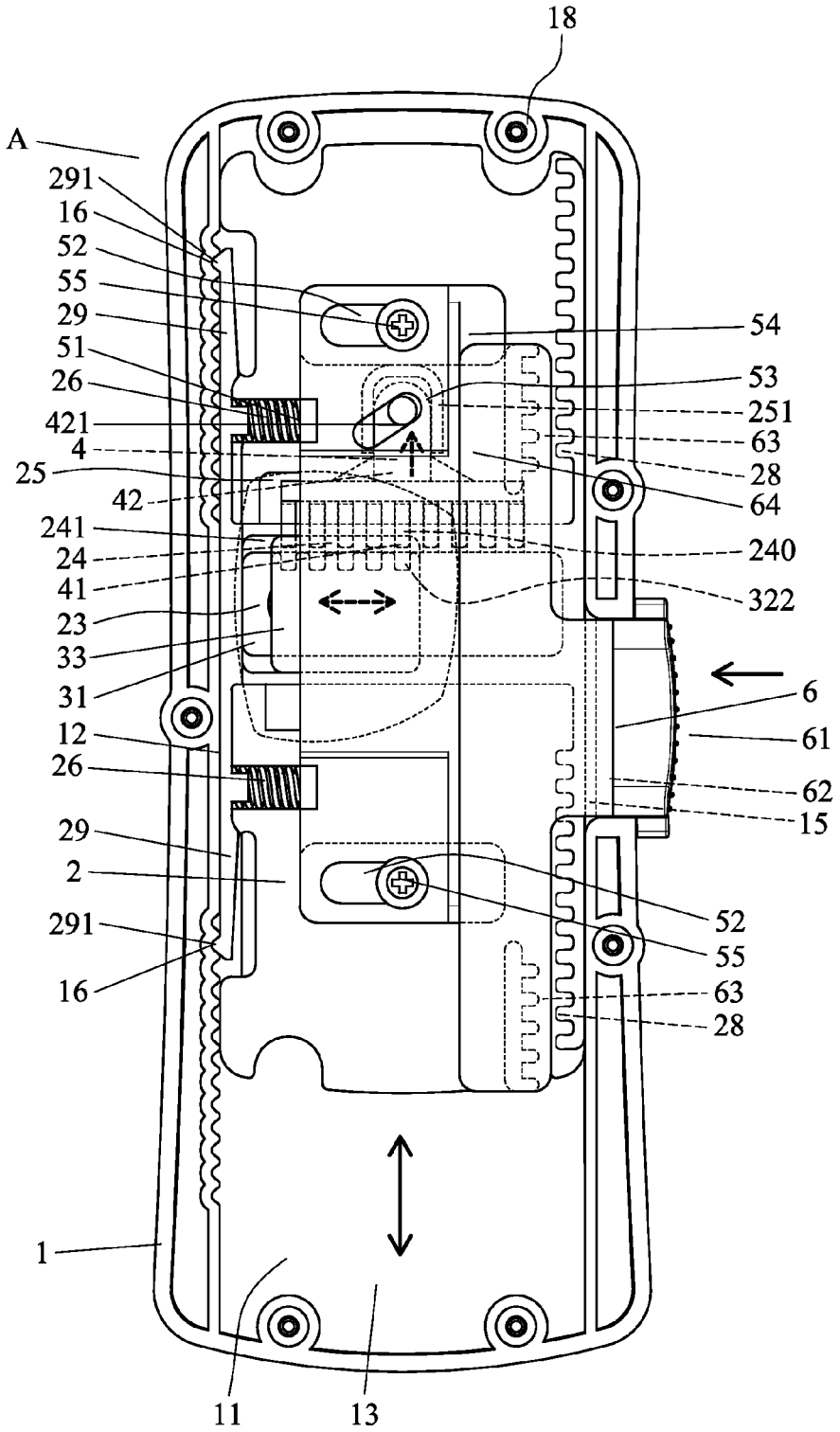
FIG. 7 is a view similar to FIG. 6, with the first control knob pressed.

With reference to FIGS. 6 and 7, when it is desired to adjust the position of the armrest unit A, the pressing portion 61 of the first control button 6 is pressed, the abutment side 64 of the first control button 6 presses against the abutment portion 54 of the actuating board 5 to move the actuating board 5 and compress the elastic elements 26. Movement of the actuating board 5 causes the teeth 41 of the transverse positioning block 4 to disengage from the tooth grooves 240 of the transverse positioning teeth 24 and the positioning grooves 322 of the base 3. Furthermore, when the pressing portion 61 is pressed, the of teeth 63 of the first control button 6 disengage from the of vertical positioning teeth 28 of the adjusting seat 2. Thus, the armrest unit A is in a state allowing adjustment in the length direction and the width direction. Specifically, the adjusting seat 2 can be moved relative to the seat 3 in the width direction to adjust the position in the width direction. Furthermore, the base 1 and the upper cover 7 can be moved relative to the adjusting seat 2 in the length direction to adjust the position of the upper cover 7 and the base 1 in the length direction. During adjustment in the length direction, the protrusion 291 on each resilient arm 29 moves across the vertical teeth 16 of the base 1 and engage with and disengage from the grooves of the vertical teeth 16 under the action of the resiliency of the resilient arm 29, providing an instant positioning effect and a sense of movement quality.

Figure 8:
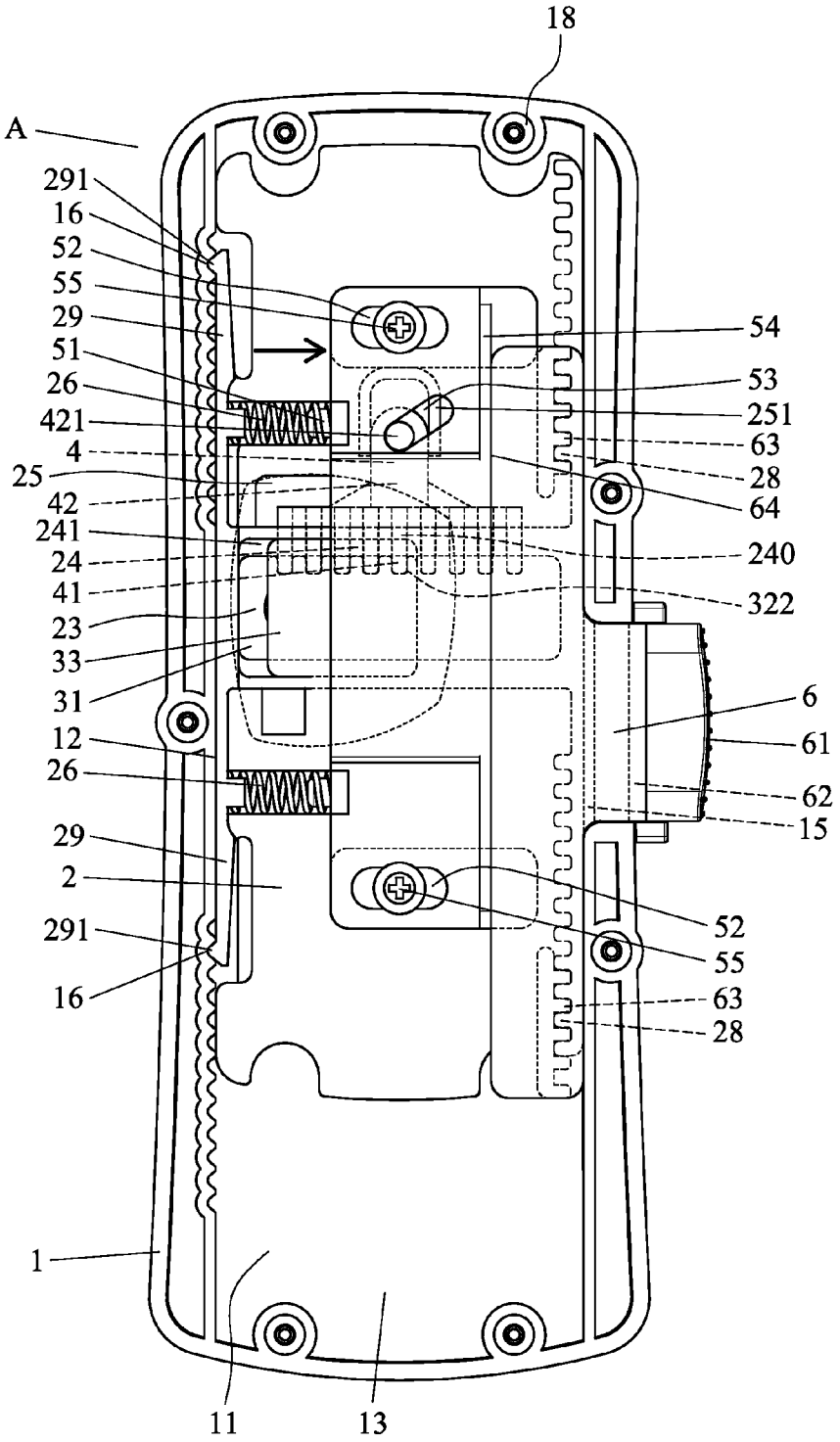
FIG. 8 is a view similar to FIG. 7, with the first control knob released after adjustment.

With reference to FIG. 8, after adjustment in the length direction and/or the width direction, the first control button 6 is released, with the elastic elements 26 bias the teeth 41 of the transverse positioning block 4 to extend through the tooth grooves 240 of the transverse positioning teeth 24 and to engage with the positioning grooves 322 of the base 3, fixing the position of the armrest unit A in the width direction. Furthermore, the teeth 63 of the first control button 6 engage with the vertical positioning teeth 28 of the adjusting seat 2 to position the armrest unit A in the length direction.

Figure 11:
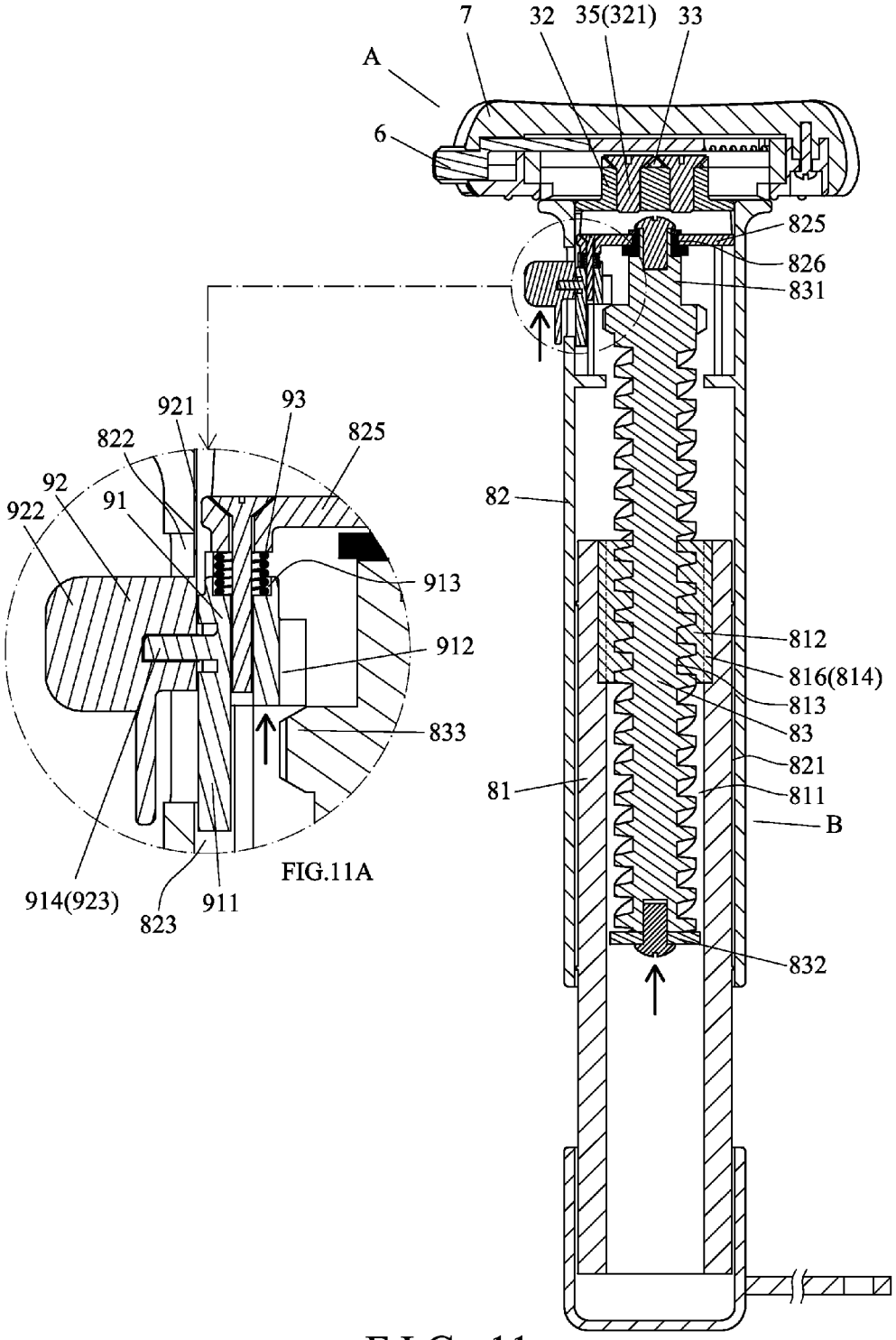
FIG. 11 is a view similar to FIG. 9, with the second control knob pressed.

With reference to FIG. 11, when it is desired to adjust the height of the armrest unit A, the manual portion 92 of the second control button 9 is moved upward in the height direction. The positioning body 91 is disengaged from the gear 833, and the elastic element 93 is compressed. Thus, the screw rod 83 and the upper rod 82 are in a free state allowing the upper rod 82 and the armrest unit A to move in the height direction relative to the lower rod 81. The screw rod 83 rotates during adjustment in the height direction.

Figure 12:
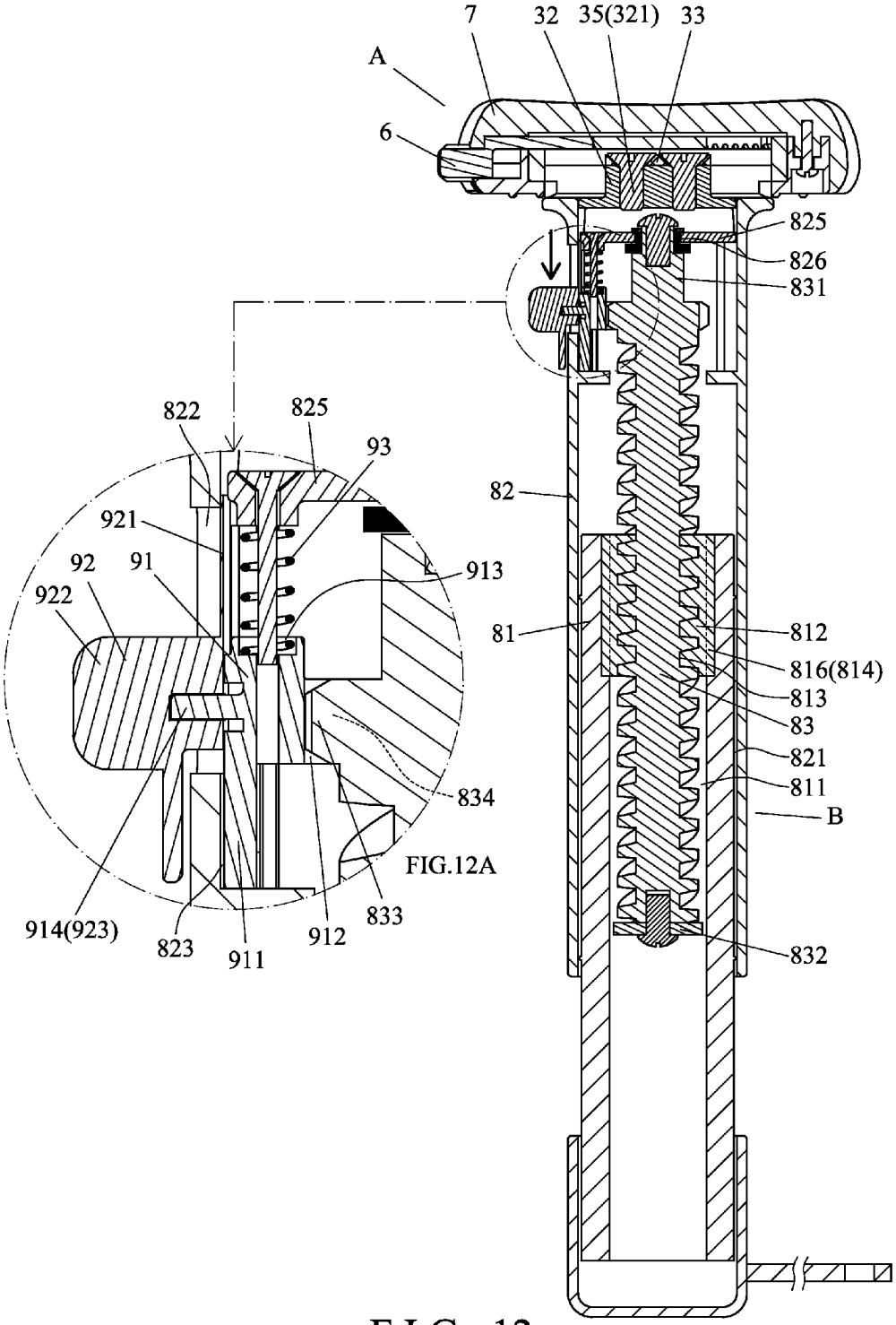
FIG. 12 is a view similar to FIG. 11, with the height of the armrest unit repositioned after adjustment.

With reference to FIG. 12, after adjustment, the second control button 9 is released, the elastic element 93 returns the positioning member 91 such that the engagement teeth 912 of the positioning body 91 engage with the gear 833 to avoid rotation of the screw rod 83 while providing convenient adjustment. During movement of the upper rod 82 in the height direction, no matter where the angular position of the screw rod 83 is, the engagement teeth 912 of the positioning body 91 can engage with corresponding tooth grooves 834 of the gear 833, providing a nearly stepless adjustment in the height direction for wider applications.

In view of the foregoing, the armrest assembly according to the present invention provides wire applications, operational stability, and assembling convenience while allowing adjustment in the length, width, and height directions.

Although specific embodiments have been illustrated and described, numerous modifications and variations are still possible without departing from the scope of the invention. The scope of the invention is limited by the accompanying claims.

The invention claimed is:

1. An armrest assembly for a chair comprising:

an armrest unit including:

a base including a receiving portion having a first sidewall and a first bottom wall, with the first sidewall including a notch, with the first bottom wall including an opening;

an adjusting seat mounted in the receiving portion of the base, with the adjusting seat including a second bottom wall and a second sidewall, with the adjusting seat having a length in a length direction smaller than a length of the receiving portion of the base in the length direction, with the base movable relative to the adjusting seat in the length direction, with the second bottom wall of the adjusting seat further including a transverse slot having a wall with a plurality of transverse positioning teeth spaced from each other in a width direction perpendicular to the length direction, with a tooth groove defined between two adjacent transverse positioning teeth, with a first elastic element including an end attached to the adjusting seat, with the second sidewall including an inner face having a plurality of vertical positioning teeth spaced from each other in the length direction;

a seat including a third bottom wall having a length in the length direction larger than a length of the transverse slot in the length direction, with the seat further including a positioning portion extending through the opening of the base and received in the transverse slot of the adjusting seat, with a mounting board mounted in the transverse slot and fixed to the positioning portion, with the mounting board having a length in the length direction larger than the length of the transverse slot, with the adjusting seat coupled to the seat and slideable relative to the seat in the width direction, with the positioning portion of the seat including a plurality of positioning grooves corresponding to the plurality of transverse positioning teeth;

a transverse positioning block mounted on the adjusting seat, with the transverse positioning block movable in the length direction, with the transverse positioning block including a plurality of teeth, with the plurality of teeth of the transverse positioning block engageable with the plurality of transverse positioning teeth and a plurality of positioning grooves of the base, with the transverse positioning block further including an engagement portion having a guiding peg;

an actuating board mounted above the transverse positioning block and movable relative to the adjusting seat in the width direction, with a first elastic element having another end attached to a side of the actuating board, with the actuating board further including a slant guiding slot extending in a direction at an acute angle to the length and width directions, with the guiding peg of the transverse positioning block slideably received in the slant guiding slot of the actuating board, with the actuating board further including an abutment portion;

a first control button including a side having a pressing portion, with the pressing portion extending out of the notch of the base, with the first control button further including a plurality of teeth engageable with the plurality of vertical positioning teeth of the adjusting seat, with the first control button further including an abutment side abutting the abutment portion of the actuating board; and an upper cover fixed to and covering the base, with the first elastic element biasing the plurality of teeth of the transverse positioning block to extend through the tooth grooves of the plurality of transverse positioning teeth and to engage with the plurality of positioning grooves of the base, with the plurality of teeth of the first control button engaged with the plurality of vertical positioning teeth of the adjusting seat, positioning the armrest unit in the length and width directions, wherein if the first control button is pressed by the pressing portion, the actuating board is moved, the plurality of teeth of the transverse positioning block disengages from the tooth grooves of the plurality of transverse positioning teeth and the plurality of positioning grooves of the base, the plurality of teeth of the first control button disengages from the plurality of vertical positioning teeth of the adjusting seat, allowing adjustment of a position of the armrest unit in the length direction and the width direction; and a support rod unit including:

a lower rod adapted to be fixed to a body of a chair, with the lower rod including a receptacle extending in an axial direction of the lower rod, with a screw rod coupling seat received in the receptacle and including a screw hole;

an upper rod including a peripheral wall having an inner peripheral face defining a longitudinal hole, with the lower rod received in the longitudinal hole of the upper rod, with the peripheral wall of the upper rod further including a window in communication with the longitudinal hole, with a connection board fixed to an upper end of the upper rod and fixed to the seat, with the connection board having an axial hole in communication with the longitudinal hole;

a screw rod recessed in the longitudinal hole of the upper rod, with the screw rod being in threading connection with the screw rod coupling seat, with an axle formed on an upper end of the screw rod, with the axle rotatably coupled to the axial hole of the connection board, with the screw rod further including a gear aligned with the window of the upper rod; and a second control button mounted in the window of the upper rod, with the second control button including an engagement tooth, with the position of the armrest unit in a height direction perpendicular to the length and width directions being fixed when the engagement teeth of the second control button engage with the gear on the screw rod, with the position of the armrest unit in the height direction being adjustable if the second control button is operated to disengage the engagement teeth from the gear on the screw rod.

2. The armrest assembly as claimed in claim 1, with the second bottom wall of the adjusting seat including two mounting holes, with the actuating board including two transverse holes aligned with the two mounting holes of the adjusting seat, with two fasteners extending through the two transverse holes of the actuating board into the two mounting holes of the adjusting seat, with the actuating board slideable relative to the adjusting seat in the width direction.

3. The armrest assembly as claimed in claim 1, with the base further including a stop wall, with the side of the first control button including an abutment edge, wherein when the first control button is pressed, the abutment edge of the first control button abuts against the stop wall of the base to stop further movement of the first control button.

4. The armrest assembly as claimed in claim 1, with the first sidewall of the base including an inner edge having a plurality of vertical teeth spaced from each other in the length direction, with the adjusting seat further including a resilient arm having a protrusion, with the protrusion of the resilient arm selectively and releasably engaged with one of the plurality of vertical teeth of the first sidewall of the base.

5. The armrest assembly as claimed in claim 1, with the lower rod further including at least one longitudinal groove defined in an inner periphery of the receptacle of the lower rod, with at least one fixing hole defined in a top end face of the lower rod, with the screw rod coupling seat including an outer periphery with at least one rib, with the screw rod coupling seat further including at least one fixing hole, with the at least one rib engaged in the at least one longitudinal groove, with at least one fastener extending through the at least one fixing hole of the screw rod coupling seat and the at least one fixing hole of the lower rod, preventing the screw rod coupling seat from rotating in the receptacle.

6. The armrest assembly as claimed in claim 1, with a third bottom wall of the base further including at least one mounting hole, with the coupling board on the upper rod including at least one mounting hole, with at least one lug formed on an inner periphery of the longitudinal groove of the upper rod and having a mounting hole, with at least one fastener extending through the at least one mounting hole of the base, the at least one mounting hole of the coupling board, and the mounting hole of the at least one lug of the upper rod.

7. The armrest assembly as claimed in claim 1, with the screw rod further including a plate fixed to a lower end of the screw rod, with the plate having a diameter larger than a diameter of the screw hole.

8. The armrest assembly as claimed in claim 1, with the upper rod further including two tracks formed on the inner peripheral face of the longitudinal hole of the upper rod, with the second control button including:

a positioning body received in the longitudinal hole of the upper rod, with the positioning body including two edges slideably received in the two tracks, with the positioning body moveable relative to the upper rod in the height direction, with the positioning body including the engagement teeth;

a manual portion aligned with the window of the upper rod, with the manual portion extending through the window and including a tab received in the longitudinal hole of the upper rod and abutting the inner peripheral face of the longitudinal hole, with the manual portion further including an operative portion located outside of the upper rod, with the manual portion coupled to the positioning body, with the manual portion and the positioning body jointly moveable in the height direction; and a second elastic element having a first end attached to the positioning body and a second end attached to the coupling board.

* * * * *